US012604962B2

(12) United States Patent
Jiang

(10) Patent No.: US 12,604,962 B2
(45) Date of Patent: Apr. 21, 2026

(54) HIGH-EFFICIENCY HEATING MODULE APPLIED TO HAIR DRYER

(71) Applicant: Dongguan Meisheng Intelligent Technology Co., Ltd., Dongguan (CN)

(72) Inventor: Junmin Jiang, Dongguan (CN)

(73) Assignee: Dongguan Meisheng Intelligent Technology Co., Ltd., Dongguan (CN)

( * ) Notice: Subject to any disclaimer, the term of this patent is extended or adjusted under 35 U.S.C. 154(b) by 162 days.

(21) Appl. No.: 18/746,397

(22) Filed: Jun. 18, 2024

(65) Prior Publication Data

US 2024/0335019 A1 Oct. 10, 2024

(30) Foreign Application Priority Data

Sep. 20, 2023 (CN) ..... 202311212296.9

(51) Int. Cl.
*A45D 20/08* (2006.01)

(52) U.S. Cl.
CPC ..... *A45D 20/08* (2013.01)

(58) Field of Classification Search
CPC ..... A45D 20/08; A45D 20/10; A45D 20/12; H05B 2203/022; H05B 2203/024; H05B 3/16
See application file for complete search history.

(56) References Cited

U.S. PATENT DOCUMENTS

2014/0144037 A1 5/2014 Hadden
2014/0326713 A1 11/2014 Chen

FOREIGN PATENT DOCUMENTS

CN 211354208 U * 8/2020
CN 114869038 A * 8/2022 ..... A45D 20/12
CN 217185130 U 8/2022
CN 116114988 A 5/2023

OTHER PUBLICATIONS

CNIPA, First Review Opinion Notice for Chinese application CN202311212296.9, Dec. 31, 2024.
CNIPA, Notification to grant patent right for Chinese application CN202311212296.9, Mar. 28, 2025.

* cited by examiner

*Primary Examiner* — Steven B McAllister
*Assistant Examiner* — Xiaoting Hu
(74) *Attorney, Agent, or Firm* — Hemisphere Law, PLLC

(57) ABSTRACT

The present disclosure relates to the technical field of hair dryers, and in particular, to a high-efficiency heating module applied to a hair dryer. The heating module includes a shell body with two run-through ends, an insulation bracket mounted in the shell body, and a heating main body fixedly mounted on the insulation bracket. The heating main body includes a heat conduction portion and a heating portion; the heat conduction portion includes a heat radiation inner cylinder, at least one layer of honeycomb-shaped heat radiation plate enclosed on an outer side of the heat radiation inner cylinder, and an outer heat radiation plate enclosed outside the outermost layer of honeycomb-shaped heat radiation plate; the heating portion includes a first heating film and a second heating film.

9 Claims, 8 Drawing Sheets

HIGH-EFFICIENCY HEATING MODULE APPLIED TO HAIR DRYER

TECHNICAL FIELD

The present disclosure relates to the technical field of hair dryers, and in particular, to a high-efficiency heating module applied to a hair dryer.

BACKGROUND

A hair dryer is a personal care type small household appliance that can quickly dry hairs. A guide fluid channel with an air outlet is arranged, and a heating module is integrated in the guide fluid channel, so that air passing through the heating module is blown out from the air outlet after being heated and acts on the hairs of a user. Due to strong permeability and radiation, far infrared has a significant temperature control effect and a resonance effect and is easily absorbed by an object and converted into internal energy of the object. After being absorbed by a human body, the far infrared can cause resonance in water molecules in the body to activate the water molecules and increase the binding force between the molecules, thereby activating biomacromolecules such as proteins, and making biological cells at the highest vibrational energy level. Due to the resonance effect generated by the biological cells, thermal energy of the far infrared can be transferred to the deeper subcutaneous part of the human body, causing the temperature of the deep subcutaneous layer to rise and causing the generated heat to be dissipated from inside to outside. Under this action, capillaries expand; the blood circulation is promoted; metabolism between tissues is enhanced; the regeneration ability of tissues is improved; body's immunity is improved; and the abnormal mental states are adjusted, thus playing a role in health care. If negative ions can be released in a hair cutting process, static electricity can be neutralized to flatten the open hair cuticles, and repair and smooth the hairs, thus playing a hair care role.

In order to generate negative ions and far infrared waves by air discharged by the hair dryer to bring therapeutic and artistic effects to the hairs, a ceramic heating element is arranged between a corresponding heating mechanism in the hair dryer and an air outlet. The ceramic heating element has a radiation rate generally greater than 85% at a room temperature (25° C. to 150° C.), has high photothermal conversion efficiency, and can generate negative ions. In this regard, the inventor proposes a novel far infrared hair dryer as described in the invention patent No. CN116114988A. A heating mechanism (a heating module) is assembled by arranging an annular heat radiation assembly, an annular heating main body, a far infrared ceramic coating layer, and a fixed bracket. The annular heating main body is configured to be powered on to perform heating and generate thermal energy. The annular heat radiation assembly is used for heat conduction. An outer surface of the annular heat radiation assembly is coated with a layer of far infrared ceramic coating layer. The far infrared ceramic coating layer is formed by mixing far infrared ceramic powder with a high-temperature-resistant adhesive, and then coats the annular heat radiation assembly, so that when the heating element generates heat, the heat can be dissipated through the annular heat radiation assembly to provide a hair drying operation. Furthermore, the heat radiation of the annular heat radiation assembly is also fully used to make the temperature of the far infrared ceramic coating layer reach 25° C. to 150° C., thus generating negative ions and far infrared waves. Due to the fixed bracket, the annular heat radiation assembly can be suspended and wound in an annular chamber, which can maximize the compactness of the overall structure and ensure a smooth air flow. The noise is reduced by reducing resistance to air, and a practical experience that the hair dryer is smaller and more comfortable is brought to a user.

The heating module is mainly limited to be a single sleeve-like structure based on a guide component arranged in the hair dryer. If the guide component is removed, a space left by removing the guide component needs to be filled with a heating module to achieve the purpose of uniform heating. A general method is to increase the number of sleeve-like structures and mutually sleeve a plurality of sleeve-like structures with different diameters to achieve uniform coverage. However, the mutual sleeving of the plurality of sleeve-like structures with different diameters may cause a tolerance, making it difficult for two adjacent sleeve-like structures to sleeve each other or causing the sleeve-like structures to shake after sleeving, for example, a graphene heating core and a hair dryer as described in the invention patent No. CN112890401. This heating module mainly involves a plurality of sleeve-like structures that are in sleeving fit. To ensure the heat conduction effect, close fit is required between a metal sheet, an outer-layer heat radiator, an outer insulation layer, a graphene heating layer, an inner insulation layer, a substrate tube, and an inner-layer heat radiator. The assembling difficulty would be greatly increased, and both the outer-layer heat radiator and the inner-layer heat radiator are enclosed by a plurality of continuous U-shaped curved panels, so that the heat radiators have a complex structure and are difficult to process. To this end, it is necessary to provide a new technical solution to solve the above problems.

SUMMARY

In order to overcome the drawbacks described above, the present disclosure aims to provide a technical solution capable of solving the above problems.

A high-efficiency heating module applied to a hair dryer includes a shell body with two run-through ends, an insulation bracket mounted in the shell body, and a heating main body fixedly mounted on the insulation bracket, wherein the heating main body includes a heat conduction portion and a heating portion; the heat conduction portion includes a heat radiation inner cylinder, at least one layer of honeycomb-shaped heat radiation plate enclosed on an outer side of the heat radiation inner cylinder, and an outer heat radiation plate enclosed outside the outermost layer of honeycomb-shaped heat radiation plate; the heating portion includes a first heating film and a second heating film; the first heating film is sandwiched between the heat radiation inner cylinder and the honeycomb-shaped heat radiation plate, and the second heating film is sandwiched between the outer heat radiation plate and the honeycomb-shaped heat radiation plate;

first heat radiation fins are uniformly arranged on an inner side of the heat radiation inner cylinder and an outer side of the outer heat radiation plate; two enclosed portions of the outer heat radiation plate have locking edges; the outer heat radiation plate is enclosed and locked by the two locking edges; the honeycomb-shaped heat radiation plate is limited between the outer heat radiation plate and the heat radiation inner cylinder;

each honeycomb-shaped heat radiation plate includes a first heat radiation plate and a second heat radiation plate that are spaced apart from each other; second heat radiation fins are uniformly arranged between the first heat radiation plate and the second heat radiation plate; coupling edges are arranged on two enclosed portions of the first heat radiation plate and the second heat radiation plate; and after being enclosed, the first heat radiation plate and the second heat radiation plate resist against and are coupled with each other through the coupling edges.

Preferably, one layer of honeycomb-shaped heat radiation plate is arranged between the heat radiation inner cylinder and the outer heat radiation plate; the first heat radiation plate is in clearance fit with the heat radiation inner cylinder; the first heating film is arranged between the first heat radiation plate and the heat radiation inner cylinder; the second heat radiation plate is in clearance fit with the outer heat radiation plate; and the second heating film is arranged between the second heat radiation plate and the outer heat radiation plate.

Preferably, the second heat radiation fins are formed on both the first heat radiation plate and the second heat radiation plate, and the heat radiation fins on the first heat radiation plate and the second heat radiation plate are arranged in a staggered manner.

Preferably, the heat radiation fins located at the two enclosed portions on the first heat radiation plate and the second heat radiation plate form the coupling edges.

Preferably, two adjacent cooperative second heat radiation fins are arranged on the first heat radiation plate, and the two second heat radiation fins form an arc-shaped hoop structure configured to wrap a temperature sensor.

Preferably, the two locking edges are parallel to each other; locking holes are formed in the two locking edges; the two locking edges are connected with bolt pieces through the locking holes; and the outer heat radiation plate is enclosed and locked by cooperation between the bolt pieces and the two locking edges.

Preferably, a layer of far infrared coating layer is arranged on a surface of each of the heat radiation inner cylinder, the honeycomb-shaped heat radiation plate, and the outer heat radiation plate.

Preferably, both the first heating film and the second heating film are made of a graphene material or a heating wire material.

Preferably, the insulation bracket includes a fixed plate and two first supporting plates; the fixed plate includes an insertion plate and two second supporting plates spaced apart on two sides of the insertion plate; a transition portion is formed between the insertion plate and a lower end of the second supporting plate; the insertion plate and the second supporting plate are integrally connected through the transition portion; the insertion plate is inserted into the heat radiation inner cylinder in a center; the first supporting plate and the second supporting plate both resist between the outer heat radiation plate and the shell body; the first supporting plate and the second supporting plate correspond vertically to each other; and the insertion plate, the first supporting plate, and the second supporting plate are all inserted through gaps reserved between two adjacent first heat radiation fins.

Compared with the prior art, the present disclosure has the beneficial effects below:

By the structural cooperation between the heat radiation inner cylinder and the outer heat radiation plate, an annular space can be formed between the heat radiation inner cylinder and the outer heat radiation plate to accommodate the at least one layer of honeycomb-shaped heat radiation plate. The honeycomb-shaped heat radiation plate uses a two-plate structural setting provided with the second heat radiation fins on one surface. By enclosing the two plates, namely by enclosing the first heat radiation plate and the second heat radiation plate, the second heat radiation fins are arranged between the first heat radiation plate and the second heat radiation plate. Furthermore, the first heat radiation plate and the second heat radiation plate are mutually restrained after being enclosed, and the heat conduction portion of the heating main body can form a multilayer finned heat radiation structure. This structure is mainly formed by assembling simple plates. The heat radiation inner cylinder, the honeycomb-shaped heat radiation plate, and the outer heat radiation plate can all be manufactured through the aluminum extrusion process. Meanwhile, design purposes of small diameter, large length, and a large number of fins can be achieved; and the surface area can be greatly enlarged, thus fully radiating heat.

By the full use of the structural cooperation between the honeycomb-shaped heat radiation plate and the heat radiation inner cylinder, as well as the outer heat radiation plate, the heating portion is sandwiched. The heating portion uses a heating film structure, which is sandwiched between the honeycomb-shaped heat radiation plate and the outer heat radiation plate, as well as between the honeycomb-shaped heat radiation plate and the heat radiation inner cylinder. If there are a plurality of layers of the honeycomb-shaped heat radiation plates, a heating film can also be arranged between two adjacent layers of honeycomb-shaped heat radiation plates. The plate structure and the heating film are in full contact, so as to achieve a design mode of sufficient heat conduction and multilayer heat conduction, ensuring uniformity of fluid heating.

The additional aspects and advantages of the present disclosure will be partially provided in the following descriptions, some of which will become apparent from the following descriptions, or learned through the practice of the present disclosure.

BRIEF DESCRIPTION OF THE DRAWINGS

To describe the technical solutions in the embodiments of the present disclosure or in the related art more clearly, the following briefly introduces the accompanying drawings for describing the embodiments or the related art. Apparently, the accompanying drawings in the following description show merely some embodiments of the present disclosure, and a person of ordinary skill in the art may still derive other drawings from the accompanying drawings without creative efforts.

Figure 1:
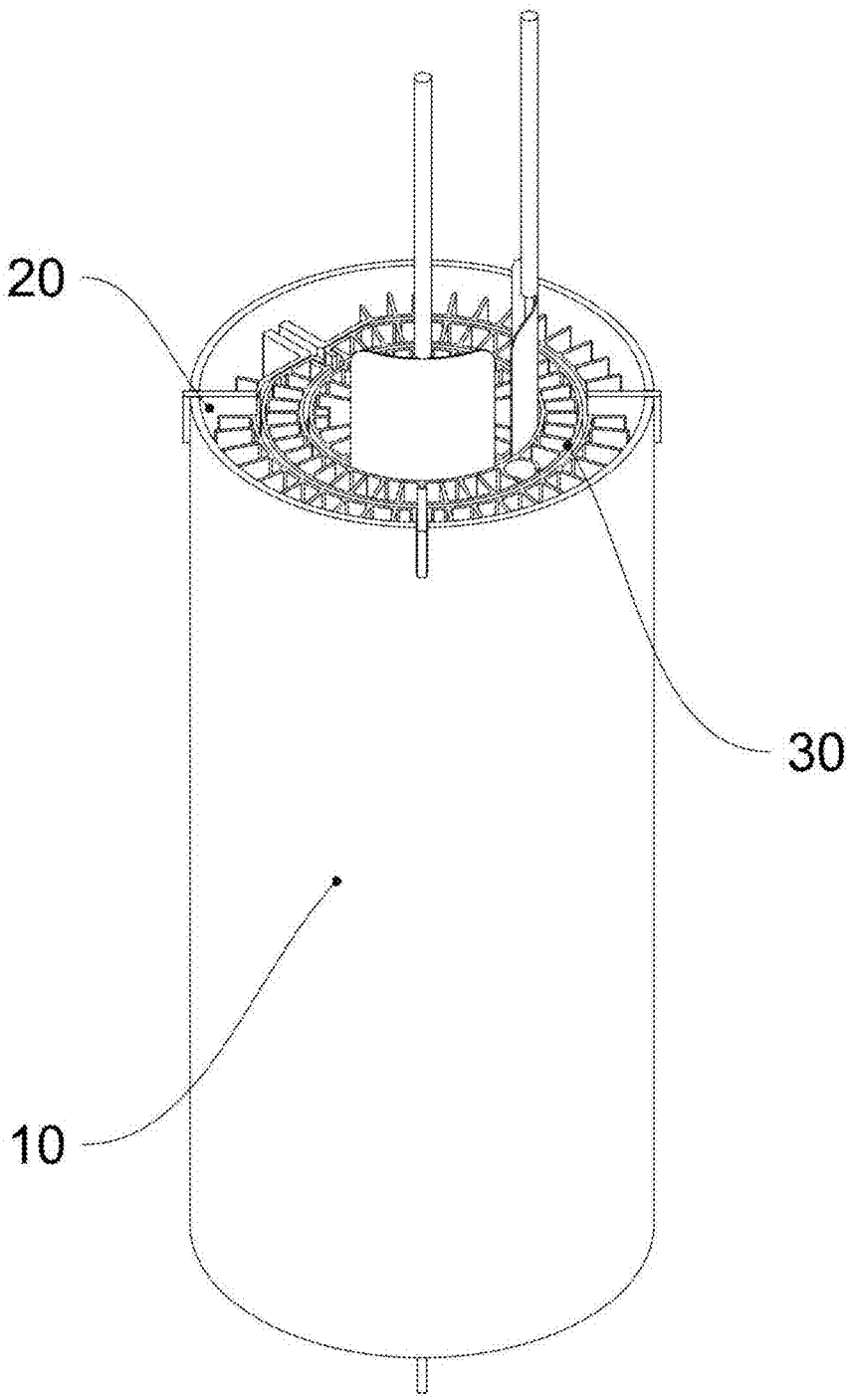
FIG. 1 is a schematic structural diagram of the present disclosure.

Reference numerals and names in the drawings are as follows:

10: shell body; 20: insulation bracket; 21: first supporting plate; 22: insertion plate; 23: second supporting plate; 24: transition portion; 30: heating main body; 31: heat radiation inner cylinder; 32: outer heat radiation plate; 33: first heating film; 34: second heating film; 35: first heat radiation fin; 36: locking edge; 37: locking hole; 38: bolt piece; 40: honeycomb-shaped heat radiation plate; 41: first heat radiation plate; 42: second heat radiation plate; 43: second heat radiation fin; 44: coupling edge; and 45: hoop structure.

DETAILED DESCRIPTION OF THE EMBODIMENTS

The technical solutions in the embodiments of the present disclosure are clearly and completely described below. Apparently, the described embodiments are merely some embodiments of the present disclosure, rather than all of the embodiments. All other embodiments obtained by a person of ordinary skill in the art based on the embodiments of present disclosure without making creative efforts shall fall within the protection scope of present disclosure.

Referring to FIG. 1 to FIG. 6, in the embodiments of the present disclosure, a high-efficiency heating module applied to a hair dryer includes a shell body 10 with two run-through ends, an insulation bracket 20 mounted in the shell body 10, and a heating main body 30 fixedly mounted on the insulation bracket 20, wherein the heating main body 30 includes a heat conduction portion and a heating portion; the heat conduction portion includes a heat radiation inner cylinder 31, at least one layer of honeycomb-shaped heat radiation plate 40 enclosed on an outer side of the heat radiation inner cylinder 31, and an outer heat radiation plate 32 enclosed outside the outermost layer of honeycomb-shaped heat radiation plate 40; the heating portion includes a first heating film 33 and a second heating film 34; the first heating film 33 is sandwiched between the heat radiation inner cylinder 31 and the honeycomb-shaped heat radiation plate 40, and the second heating film 34 is sandwiched between the outer heat radiation plate 32 and the honeycomb-shaped heat radiation plate 40; first heat radiation fins 35 are uniformly arranged on an inner side of the heat radiation inner cylinder 31 and an outer side of the outer heat radiation plate 32; two enclosed portions of the outer heat radiation plate 32 have locking edges 36; the outer heat radiation plate 32 is enclosed and locked by the two locking edges 36; the honeycomb-shaped heat radiation plate 40 is limited between the outer heat radiation plate 32 and the heat radiation inner cylinder 31;

each honeycomb-shaped heat radiation plate 40 includes a first heat radiation plate 41 and a second heat radiation plate 42 that are spaced apart from each other; second heat radiation fins 43 are uniformly arranged between the first heat radiation plate 41 and the second heat radiation plate 42; coupling edges 44 are arranged on two enclosed portions of the first heat radiation plate 41 and the second heat radiation plate 42; and after being enclosed, the first heat radiation plate 41 and the second heat radiation plate 42 resist against and are coupled with each other through the coupling edges 44.

Figure 5:
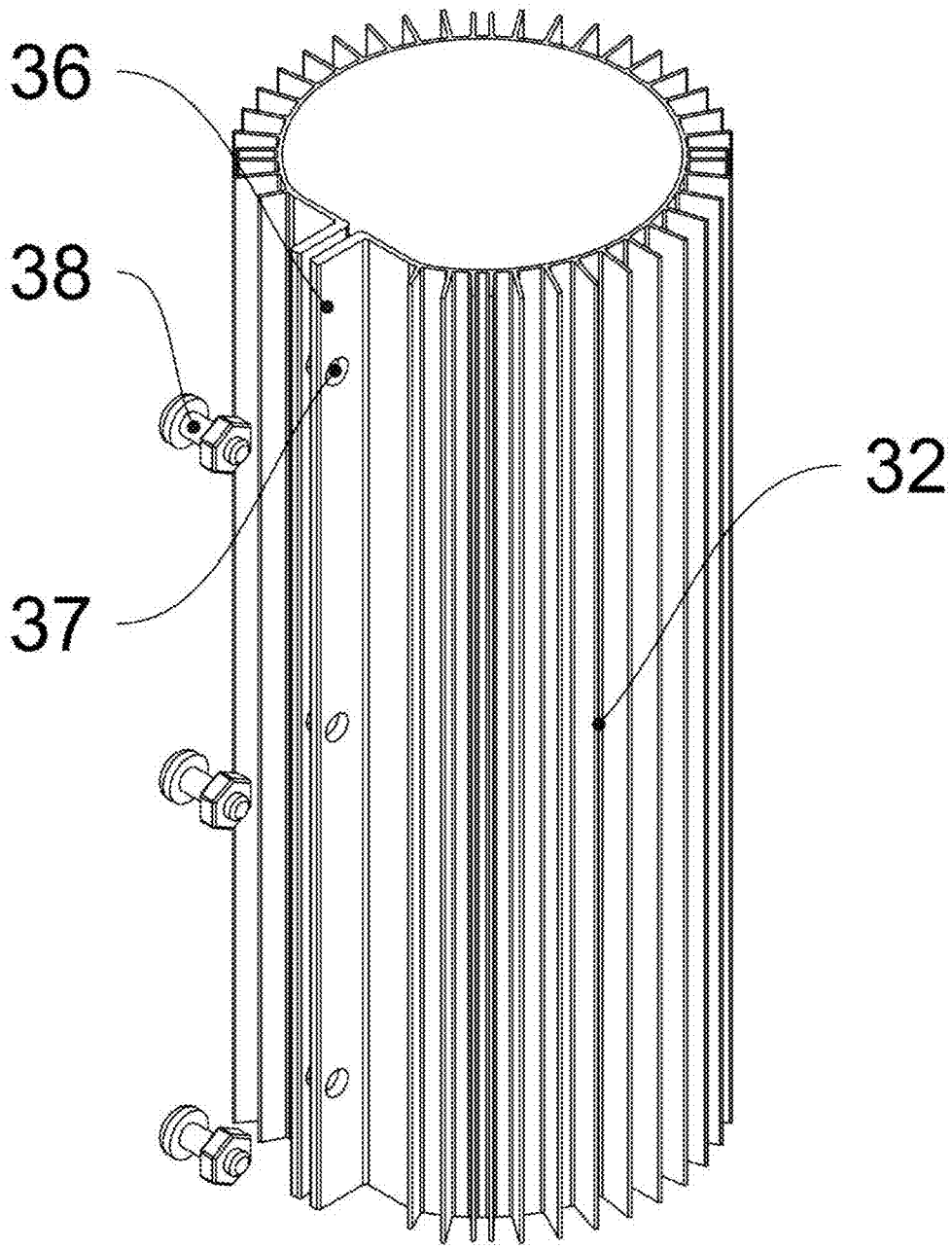
FIG. 5 is a schematic structural diagram of an outer heat radiation plate in the present disclosure.
Figure 7:
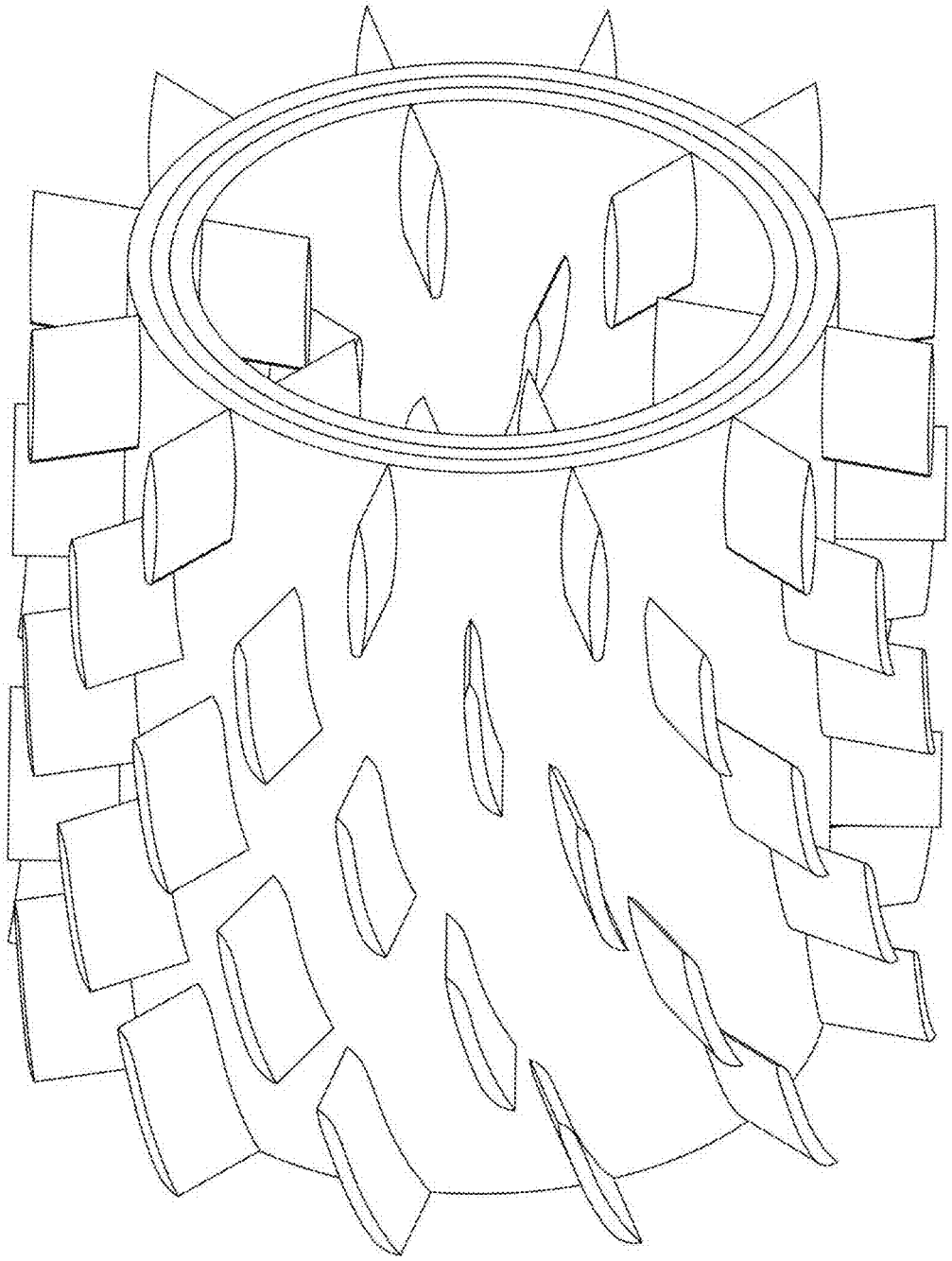
FIG. 7 is a schematic structural diagram of a heat radiation fin in the present disclosure.
Figure 8:
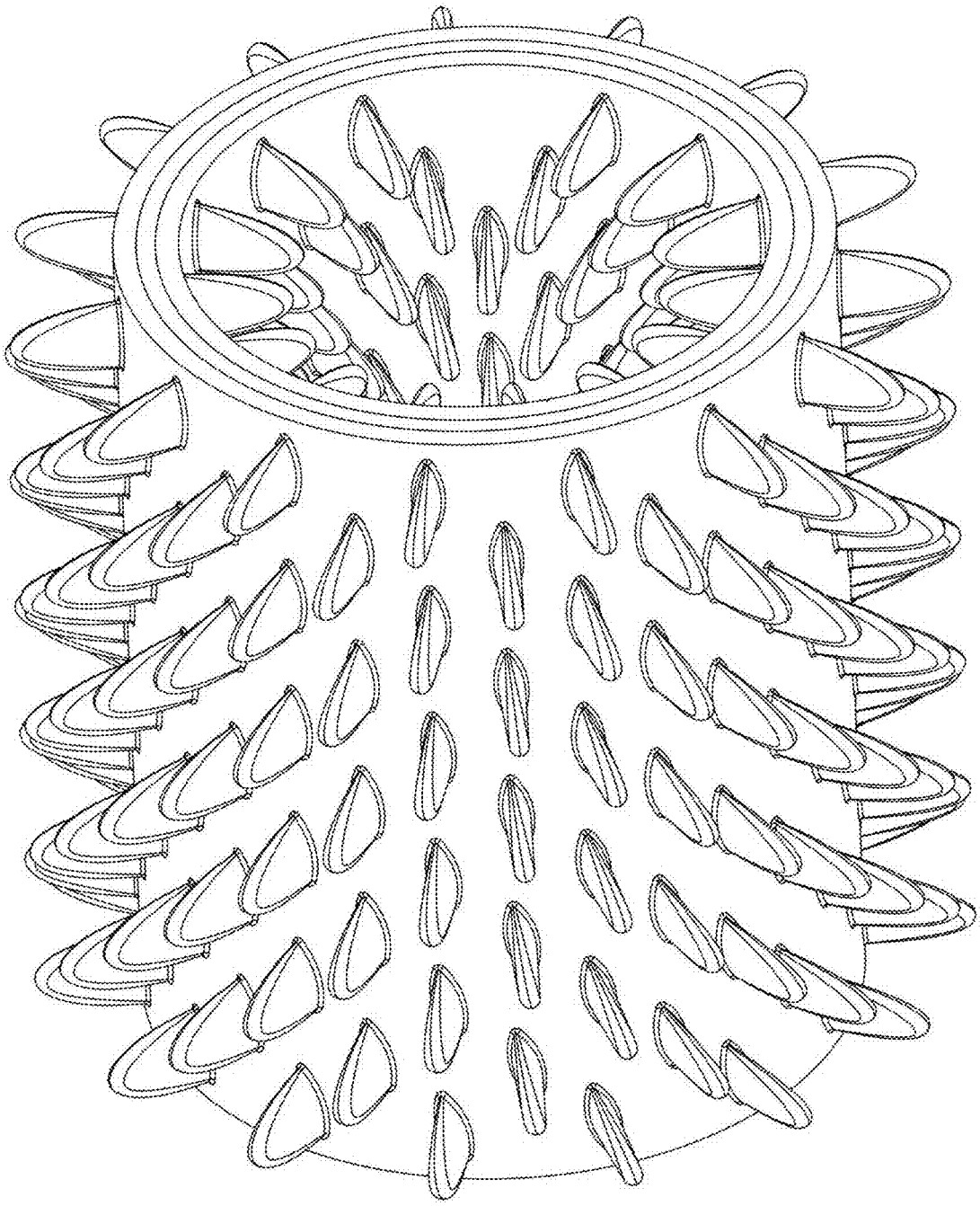
FIG. 8 is a schematic structural diagram of another heat radiation fin in the present disclosure.

In the above technical solution, by the structural cooperation between the heat radiation inner cylinder 31 and the outer heat radiation plate 32, an annular space can be formed between the heat radiation inner cylinder 31 and the outer heat radiation plate 32 to accommodate the at least one layer of honeycomb-shaped heat radiation plate 40. The honeycomb-shaped heat radiation plate 40 uses a two-plate structural setting provided with the second heat radiation fins 43 on one surface. By enclosing the two plates, namely by enclosing the first heat radiation plate 41 and the second heat radiation plate 42, the second heat radiation fins 43 are arranged between the first heat radiation plate 41 and the second heat radiation plate 42. Furthermore, the first heat radiation plate 41 and the second heat radiation plate 42 are mutually restrained after being enclosed, and the heat conduction portion of the heating main body 30 can form a multilayer finned heat radiation structure. This structure is mainly formed by assembling simple plates. The heat radiation inner cylinder 31, the honeycomb-shaped heat radiation plate 40, and the outer heat radiation plate 32 can all be manufactured through the aluminum extrusion process. Meanwhile, design purposes of small diameter, large length, and a large number of fins can be achieved; and the surface area can be greatly enlarged, thus fully radiating heat. Furthermore, the first heat radiation fins 35 and the second heat radiation fins 43 are preferably of air guide structures in structural design. As shown in FIG. 5, FIG. 7, and FIG. 8, the heat radiation fins may be of strip structures, or a plurality of arrayed bulge structures. The bulge structures may be cambered structures that can guide and generate a spiral effect. The heat radiation fins are set according to an actual situation.

By the full use of the structural cooperation between the honeycomb-shaped heat radiation plate 40 and the heat radiation inner cylinder 31, as well as the outer heat radiation plate 32, the heating portion is sandwiched. The heating portion uses a heating film structure, which is sandwiched between the honeycomb-shaped heat radiation plate 40 and the outer heat radiation plate 32, as well as between the honeycomb-shaped heat radiation plate 40 and the heat radiation inner cylinder 31. If there are a plurality of layers of the honeycomb-shaped heat radiation plates 40, a heating film can also be arranged between two adjacent layers of honeycomb-shaped heat radiation plates 40. The plate structure and the heating film are in full contact, so as to achieve a design mode of sufficient heat conduction and multilayer heat conduction, ensuring uniformity of fluid heating.

Figure 2:
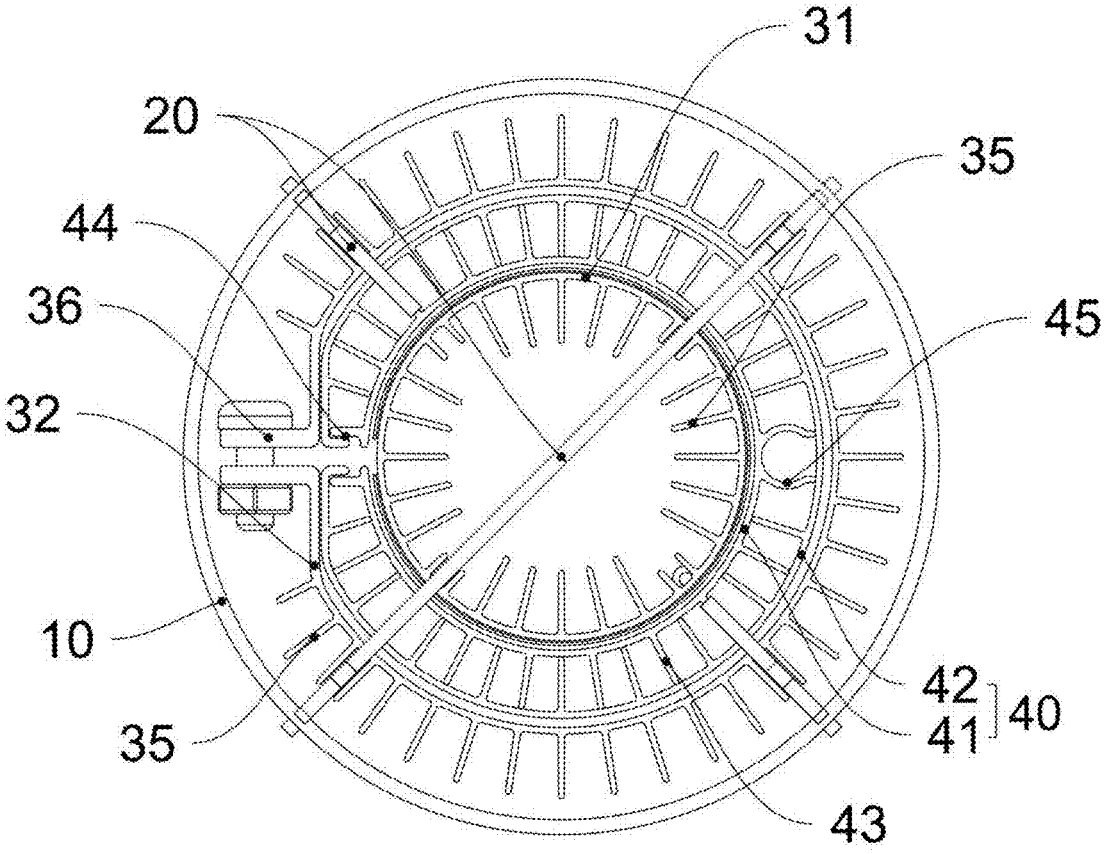
FIG. 2 is a schematic structural diagram of a top view of the present disclosure.
Figure 3:
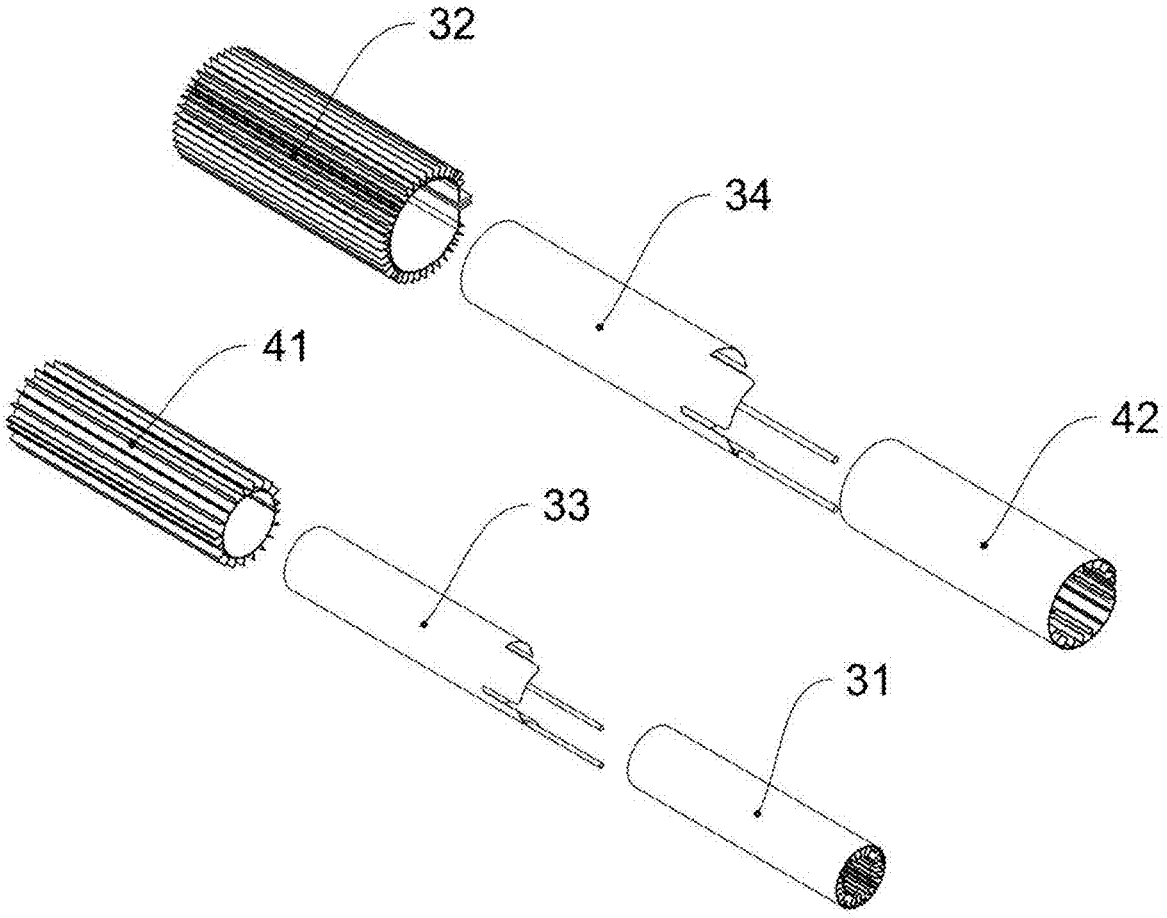
FIG. 3 is a schematic diagram of an exploded structure according to the present disclosure.
Figure 4:
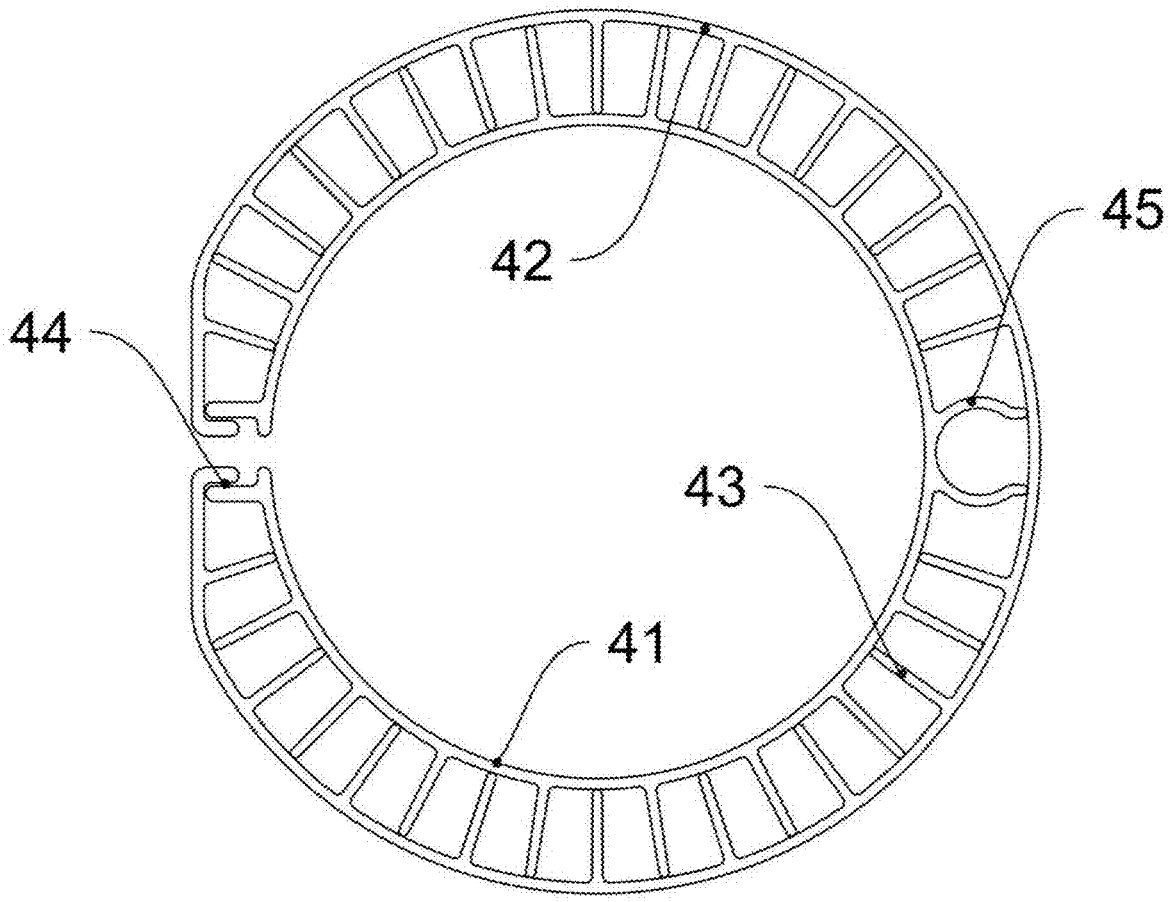
FIG. 4 is a schematic structural diagram of a honeycomb-shaped heat radiation plate in the present disclosure.

Referring to FIG. 2 and FIG. 4, one layer of honeycomb-shaped heat radiation plate 40 arranged between the heat radiation inner cylinder 31 and the outer heat radiation plate 32 is taken as an example. The first heat radiation plate 41 and the heat radiation inner cylinder 31 are in clearance fit; the first heating film 33 is arranged between the first heat radiation plate 41 and the heat radiation inner cylinder 31; the second heat radiation plate 42 and the outer heat radiation plate 32 are in clearance fit; and the second heating film 34 is arranged between the second heat radiation plate 42 and the outer heat radiation plate 32. Based on the cooperation of the second heat dissipation fins 43, the second heat radiation fins 43 are formed on both the first heat radiation plate 41 and the second heat radiation plate 42, and the heat dissipation fins on the first heat radiation plate 41 and the second heat radiation plate 42 are staggered from each other, so that the first heat radiation plate 41 and the second heat radiation plate 42 can be restrained each other to prevent sliding. In addition, by the full use of the structure of the second heat dissipation fins 43, the heat dissipation fins, located at the two enclosed portions, on the first heat radiation plate 41 and the second heat radiation plate 42 form the coupling edges 44. Two adjacent cooperative second heat radiation fins 43 are arranged on the first heat radiation plate 41, and the two second heat radiation fins 43 form an arc-shaped hoop structure 45 configured to wrap a temperature sensor, so that the overall structure is compact, and no parts for fixing will be added.

Referring to FIG. 2 and FIG. 5, the two locking edges 36 are parallel to each other; locking holes 37 are formed in the two locking edges 36; the two locking edges 36 are connected with bolt pieces 38 through the locking holes 37; and the outer heat radiation plate 32 is enclosed and locked by cooperation between the bolt pieces 38 and the two locking edges 36. According to the design, the two locking edges 36 can be spaced apart from each other. As the bolt pieces 38 are screwed up, the compactness of structural cooperation between the heat dissipation inner cylinder 31, the outer heat dissipation plate 32, and the honeycomb-shaped heat dissipation plate 40 can be ensured.

A layer of far infrared coating layer (not shown in the figure) is arranged on a surface of each of the heat radiation inner cylinder 31, the honeycomb-shaped heat radiation plate 40, and the outer heat radiation plate 32, is configured to generate far infrared rays, and has high penetrability and radiation power. Capillaries expand; the blood circulation is promoted; metabolism between tissues is enhanced; the regeneration ability of tissues is improved; body's immunity is improved; and the abnormal mental states are adjusted, thus playing a role in health care. If negative ions can be released in a hair cutting process, static electricity can be neutralized to flatten the open hair cuticles, and repair and smooth the hairs, thus playing a hair care role.

The first heating film 33 and the second heating film 34 are both made of a graphene material or a heating wire material. Graphene generates heat through friction between carbon atoms. This frictional motion is an irregular motion, also referred to as Brownian motion. The graphene, as a far infrared heating mode, releases a life light of 8 to 15 microns. This light is the same as the sun. After being in contact with the human body, the light can resonate and be absorbed and converted by the human body. Therefore, the far infrared rays released during the heating of the graphene is therapeutic light that is beneficial for the human body. Therefore, in this embodiment, the graphene material is preferably used to make the first heating film 33 and the second heating film 34, which can achieve a more efficient hair cutting effect.

Figure 6:
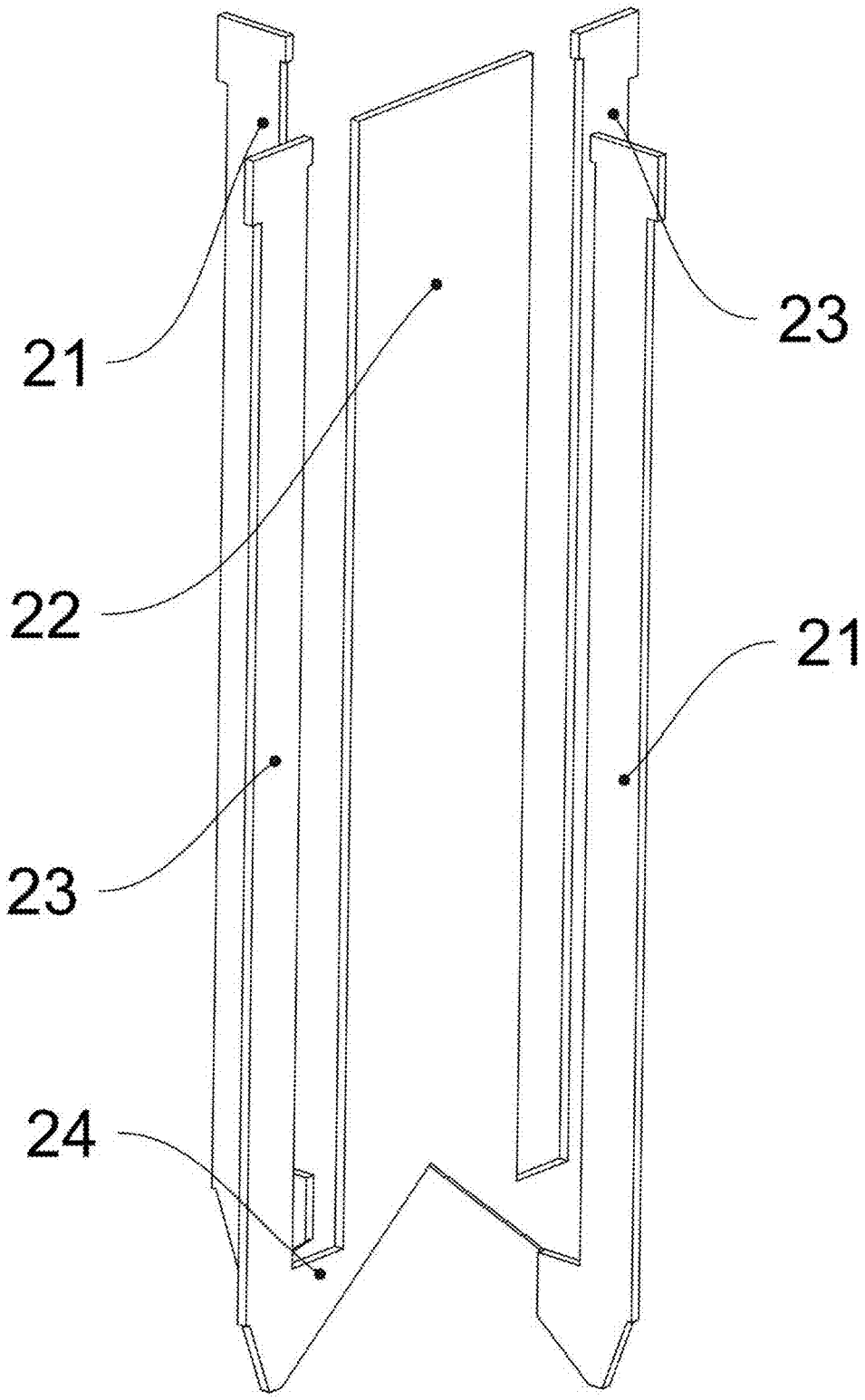
FIG. 6 is a schematic structural diagram of an insulation bracket in the present disclosure.

Referring to FIG. 6, the insulation bracket 20 includes a fixed plate and two first supporting plates 21; the fixed plate includes an insertion plate 22 and two second supporting plates 23 spaced apart on two sides of the insertion plate 22; a transition portion 24 is formed between the insertion plate 22 and a lower end of the second supporting plate 23; the insertion plate 22 and the second supporting plate 23 are integrally connected through the transition portion 24; the insertion plate 22 is inserted into a center of the heat radiation inner cylinder 31; the first supporting plate 21 and the second supporting plate 23 both resist between the outer heat radiation plate 32 and the shell body 10; the first supporting plate 21 and the second supporting plate 23 correspond vertically to each other; and the insertion plate 22, the first supporting plate 21, and the second supporting plate 23 are all inserted through gaps reserved between two adjacent first heat radiation fins 35. By the arrangement of the insertion plate 22, the first supporting plate 21, and the second supporting plate 23, the entire heating main body 30 is restrained between the insertion plate 22 and the supporting plates, thereby ensuring the firmness of fixing of the heating main body 30 and insulating the heating main body from the shell body 10.

For those skilled in the art, it is apparent that the present disclosure is not limited to the details of the exemplary embodiments mentioned above, and can be implemented in other specific forms without departing from the spirit or basic features of the present disclosure. Therefore, in any perspective, the embodiments should be regarded as exemplary and non-restrictive. The scope of the present disclosure is limited by the accompanying claims rather than the above description. Therefore, all changes within the meaning and scope of the equivalent conditions of the claims within the present disclosure.

What is claimed is:

1. A high-efficiency heating module applied to a hair dryer, comprising a shell body with two run-through ends, an insulation bracket mounted in the shell body, and a heating main body fixedly mounted on the insulation bracket, wherein the heating main body comprises a heat conduction portion and a heating portion; the heat conduction portion comprises a heat radiation inner cylinder, at least one layer of honeycomb-shaped heat radiation plate enclosed on an outer side of the heat radiation inner cylinder, and an outer heat radiation plate enclosed outside the outermost layer of honeycomb-shaped heat radiation plate; the heating portion comprises a first heating film and a second heating film; the first heating film is sandwiched between the heat radiation inner cylinder and the honeycomb-shaped heat radiation plate, and the second heating film is sandwiched between the outer heat radiation plate and the honeycomb-shaped heat radiation plate;

first heat radiation fins are uniformly arranged on an inner side of the heat radiation inner cylinder and an outer side of the outer heat radiation plate; two enclosed portions of the outer heat radiation plate have locking edges; the outer heat radiation plate is enclosed and locked by the two locking edges; the honeycomb-shaped heat radiation plate is limited between the outer heat radiation plate and the heat radiation inner cylinder;

each honeycomb-shaped heat radiation plate comprises a first heat radiation plate and a second heat radiation plate that are spaced apart from each other; second heat radiation fins are uniformly arranged between the first heat radiation plate and the second heat radiation plate; coupling edges are arranged on two enclosed portions of the first heat radiation plate and the second heat radiation plate; and after being enclosed, the first heat radiation plate and the second heat radiation plate resist against and are coupled with each other through the coupling edges.

2. The high-efficiency heating module applied to the hair dryer according to claim 1, wherein one layer of honeycomb-shaped heat radiation plate is arranged between the heat radiation inner cylinder and the outer heat radiation plate; the first heat radiation plate is in clearance fit with the heat radiation inner cylinder; the first heating film is arranged between the first heat radiation plate and the heat radiation inner cylinder; the second heat radiation plate is in clearance fit with the outer heat radiation plate; and the second heating film is arranged between the second heat radiation plate and the outer heat radiation plate.

3. The high-efficiency heating module applied to the hair dryer according to claim 2, wherein the second heat radiation fins are formed on both the first heat radiation plate and the second heat radiation plate, and the heat radiation fins on the first heat radiation plate and the second heat radiation plate are arranged in a staggered manner.

4. The high-efficiency heating module applied to the hair dryer according to claim 3, wherein the heat radiation fins located at the two enclosed portions on the first heat radiation plate and the second heat radiation plate form the coupling edges.

5. The high-efficiency heating module applied to the hair dryer according to claim 2, wherein two adjacent cooperative second heat radiation fins are arranged on the first heat radiation plate, and the two second heat radiation fins form an arc-shaped hoop structure configured to wrap a temperature sensor.

6. The high-efficiency heating module applied to the hair dryer according to claim 1, wherein the two locking edges are parallel to each other; locking holes are formed in the two locking edges; the two locking edges are connected with bolt pieces through the locking holes; and the outer heat radiation plate is enclosed and locked by cooperation between the bolt pieces and the two locking edges.

7. The high-efficiency heating module applied to the hair dryer according to claim 1, wherein a layer of far infrared coating layer is arranged on a surface of each of the heat radiation inner cylinder, the honeycomb-shaped heat radiation plate, and the outer heat radiation plate.

8. The high-efficiency heating module applied to the hair dryer according to claim 1, wherein both the first heating film and the second heating film are made of a graphene material or a heating wire material.

9. The high-efficiency heating module applied to the hair dryer according to claim 1, wherein the insulation bracket comprises a fixed plate and two first supporting plates; the fixed plate comprises an insertion plate and two second supporting plates spaced apart on two sides of the insertion plate; a transition portion is formed between the insertion plate and a lower end of the second supporting plate; the insertion plate and the second supporting plate are integrally connected through the transition portion; the insertion plate is inserted into a center of the heat radiation inner cylinder; the first supporting plate and the second supporting plate both resist between the outer heat radiation plate and the shell body; the first supporting plate and the second supporting plate correspond vertically to each other; and the insertion plate, the first supporting plate, and the second supporting plate are all inserted through gaps reserved between two adjacent first heat radiation fins.

* * * * *